United States Patent [19]

Miyamoto et al.

[11] Patent Number: 4,885,213

[45] Date of Patent: Dec. 5, 1989

[54] CERAMIC-SPRAYED MEMBER AND PROCESS FOR MAKING THE SAME

[75] Inventors: Noritaka Miyamoto; Miyuki Koujiya, both of Toyota; Joji Miyake, Okazaki; Takashi Iomoda, Nagoya; Hidetoshi Ohsawa, Toyota; Tetsuo Nagami, Nagoya, all of Japan

[73] Assignee: Toyota Jidosha Kabushiki Kaisha, Toyota, Japan

[21] Appl. No.: 187,242

[22] Filed: Apr. 28, 1988

[51] Int. Cl.[4] ..... B32B 3/02

[52] U.S. Cl. ..... 428/612; 428/632; 428/633; 428/652; 428/680

[58] Field of Search ..... 428/609, 610, 612, 632, 428/633, 652, 680

[56] References Cited

U.S. PATENT DOCUMENTS 4,569,889 2/1986 Przybyszewski et al. ..... 428/612

FOREIGN PATENT DOCUMENTS 2872 1/1982 Japan .
87859 5/1986 Japan .
207566 9/1986 Japan ..... 428/652

OTHER PUBLICATIONS

"Cummins/TACOM Advanced Adiabatic Engine", R. Kamo et al., SAE Papers No. 840428.

*Primary Examiner*—L. Dewayne Rutledge
*Assistant Examiner*—George Wyszomierski
*Attorney, Agent, or Firm*—Finnegan, Henderson, Farabow, Garrett & Dunner

[57] ABSTRACT

A sprayed member which has a ceramic-sprayed layer formed on the surface of a parent material of an aluminum alloy through a sprayed bond layer. A diffusion layer occupies 20 to 50% of the entire interface between the bond layer and the parent material. The interface between the diffusion layer and the parent material and the interface between the bond layer and the parent material are finely roughened to have a height of several microns. The diffusion layer and the fine roughness are formed by preheating the surface of the parent material at a temperature ranging from 260° to 500° C. prior to spraying the parent material with a material for the bond layer so that they can together enhance the adherency between the bond layer and the parent material.

4 Claims, 3 Drawing Sheets

CERAMIC-SPRAYED MEMBER AND PROCESS FOR MAKING THE SAME

BACKGROUND OF THE INVENTION

The present invention relates to a ceramic-sprayed member made of an aluminum alloy as a parent material and formed with a ceramic-sprayed layer on its surface and, more particularly, to a ceramic-sprayed member to be used as either a member or the piston head of an automotive engine which, for example, is required to have heat resistance and heat insulating properties or wear resistance.

In recent years, ceramic members, which have their heat resistances or heat insulating properties improved by spraying the surface of a parent material or aluminum alloy with a ceramic having a low thermal conductivity and excellent heat insulating properties to form a ceramic-sprayed layer, are used for a member to be partially heated to a high temperature, such as the piston of an automotive engine. The cylinder bore of the automotive engine or a member having a sliding surface required to have wear resistance is also formed with the ceramic-sprayed layer so as to improve the wear resistance of the surface of the parent material of an aluminum alloy.

In the member having the ceramic-sprayed layer on the parent material of the aluminum alloy, however, there is a substantial difference between the coefficients of thermal expansion of the aluminum alloy and the material of the ceramic-sprayed layer. This difference causes an engine member repeatedly heated and cooled to be repeatedly subjected to a high thermal stress. As a result, the interface between the ceramic-sprayed layer and the parent material and the inside of the ceramic-sprayed layer will crack until the ceramic-sprayed layer will possibly peel from the surface of the parent material. In case the ceramic-sprayed layer is formed on the sliding surface also required to have wear resistance, a shearing stress acts between the ceramic-sprayed layer and the parent material so that their interface will frequently crack until the ceramic-sprayed layer peels from the parent material.

In order to prevent these problems, therefore, there is a conventional process for forming the ceramic-sprayed layer on the parent material of an aluminum alloy. With a view to preventing the ceramic-sprayed layer from peeling, according to the known process (e.g., "Cummins/TACOM Advanced Adiabatic Engine", R. Kamo et al., SAE Papers No. 840428), the parent material is thinly sprayed in advance on its surface with an alloy, which has a coefficient of thermal expansion intermediate the parent or aluminum alloy and a ceramic and has excellent adherence to the ceramic, e.g., mainly a nickel-based alloy such as an alloy of Ni—Cr, Ni—Al, Ni—Cr—Al, Ni—Cr—Al—Y or Ni—Co—Cr—Al—Y to form a primary sprayed layer called the "bond layer" or "intermediate layer", and this primary sprayed layer is has its surface sprayed with the ceramic. Even when such primary sprayed layer is sandwiched between the parent aluminum alloy and the ceramic-sprayed layer, however, the adherency between the two is not sufficient. As a result, the parent material and the primary sprayed layer will crack due to a thermal stress or a mechanical shearing stress to make it impossible to prevent the sprayed layer from peeling.

In Japanese Patent KOKAI No. 87859/1986, there is proposed a process for improving the adherency between the primary sprayed layer and the parent aluminum alloy. According to this process, a base of Al or its alloy is sprayed with a primary layer of an alloy of Ni—Cr or Ni—Al, and this primary layer is formed thereon with a ceramic-sprayed layer. At the spraying step of the primary layer, the base is heated at 130° to 250° C. As a result of this heating, the primary layer is sprayed to extend into the base being expanded so that the adherency of the primary layer to the base is improved.

On the other hand, generally speaking, the adherency between a parent material and a sprayed layer of the alloy of Ni—Cr is improved by another process, as disclosed in Japanese Patent KOKAI No. 2872/1982. According to this process, a heat treatment is accomplished after the spray of the Ni—Cr alloy to establish a mutual diffusion between the parent material and the sprayed layer to enhance the adherency.

According to still another process, on the other hand, the parent aluminum alloy has its surface roughened in advance by a shot-blasting or grooving step, the roughened surface is then sprayed with a primary layer and further with a ceramic material. This process is expected to enhance the adherency of the primary sprayed layer by the mechanical anchoring effect of the material for the primary spray, which effect is attained by the roughness of the parent surface.

As a matter of fact, however, even the process of preheating the parent material at 130° to 250° C. at the step of spraying the bond layer (as has been disclosed in Japanese Patent KOKAI No. 87859/1986) has been found to result in difficulty in achieving sufficient inherence of the bond layer and the parent material and has failed to avoid the problem a peeling of the sprayed layer due to thermal stress or the mechanical shearing stress.

As is disclosed in Japanese Patent KOKAI No. 2872/1982, on the other hand, the heat treatment involved in the process for the mutual diffusion after the spray of the Ni-based alloy has to be continued at a considerably high temperature for a period as long as several tens to hundreds hours, because the diffusion is in a solid phase, so that the diffusion may be sufficient for enhancing the adherency. This long heat treatment drastically deteriorates the workability and productivity. Moreover, the solid-state diffusion of the process proposed has also found it practically difficult to complete the diffusion to achieve sufficient adherency. This difficulty in turn limits the effect of improving the adherency.

On the other hand, the process itself for improving the adherency of the primary sprayed layer by the mechanical anchoring effect which is obtained by roughening the surface of the parent material is not sufficient to achieve the required improvement and thus it also results in difficulty in preventing the sprayed layer from peeling.

SUMMARY OF THE INVENTION

The present invention has been conceived in view of the background thus far described and has as an object to provide both a ceramic-sprayed member, which is made by spraying to form a primary (or bond) layer of a material represented by a Ni-based alloy on a parent material of an aluminum alloy and by forming a ceramic-sprayed layer on the bond layer so that the adherency of the bond layer to the parent material may be sufficiently enhanced to prevent the sprayed layer from peeling and to enhance the durability, and to a process for making the ceramic-sprayed member.

We have repeated a variety of experiments and investigations so as to solve the problems specified above and have found that the adherency of the bond layer to the parent material could be improved drastically better than that of the prior art: by preheating the surface of the parent aluminum alloy at such a temperature as high as 260° to 500° C. or desirably 350° to 450° C., as could never be conceived in the prior art, when the material for the primary (or bond) layer represented by a Ni-based alloy is to be sprayed; and by spraying the bond layer forming material in the preheated state. We have also examined the interface between the parent material and the bond layer, which was given a high adherency by spraying the bond layer forming material such as a Ni-based alloy over the surface of the parent aluminum alloy preheated at that high temperature. After these examinations, we have confirmed that a diffusion layer due to a liquid phase was formed to occupy 20 to 50% of all the interface and that the interface was finely roughened to have a height of several microns. These confirmations have revealed that the interface conditions highly contribute to the improvement in adherency and have led us the present invention.

According to a feature of the present invention, there is provided a ceramic-sprayed member made by forming a ceramic-sprayed layer on the surface of a parent material of an aluminum alloy through a sprayed bond layer which is made of an alloy having a coefficient of thermal expansion intermediate between those of the aluminum alloy of the parent material and a ceramic and an excellent adherency to the ceramic, wherein the improvement resides: in that a diffusion layer, in which the components of said bond layer and said parent material diffuse into each other, is so formed in the interface between said bond layer and said parent material as to occupy 20 to 50% of all said interface in an area percentage; and in that the interface between said diffusion layer and said parent material and the interface between said bond layer and said parent material are finely roughened substantially all over the interfaces.

According to another feature of the present invention, there is provided a process for making a ceramic-sprayed member, comprising the steps of: spraying an alloy, which has a coefficient of thermal expansion intermediate between those of a parent material of an aluminum alloy and a ceramic and an excellent adherency to the ceramic, over the surface of said parent material to form a bond layer; and spraying said ceramic over said bond layer, wherein the improvement comprises the step of preheating the surface of said parent material at a temperature ranging from 260° to 500° C. prior to the first-named spraying step to melt the surface of said parent material through the bombardment of the surface of said parent material with the bond layer forming spray material so that a diffusion layer, in which the components of said bond layer and said parent material diffuse into each other, may be so formed in the interface between said bond layer and said parent material as to occupy 20 to 50% of all said interface in area percentage and so that said diffusion layer and the interface between said bond layer and said parent material may be finely roughened substantially all over the surfaces thereof.

DETAILED DESCRIPTION OF THE INVENTION

Figure 1:
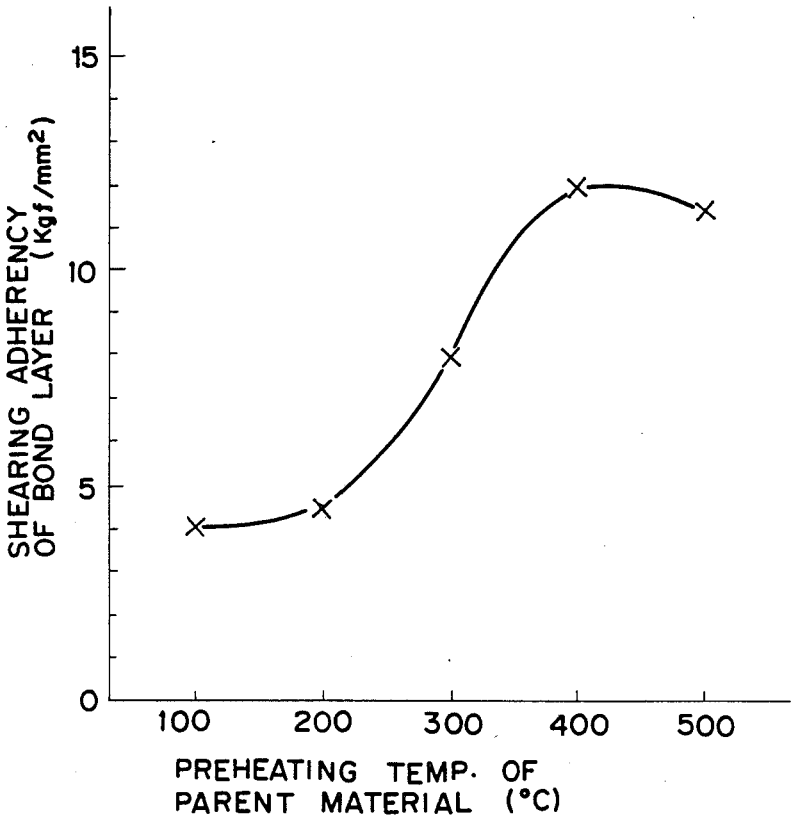
FIG. 1 is a graph presenting the relation between the preheating temperature of a parent material and the shearing adherency of a bond layer.

First of all, the operations of preheating a parent aluminum alloy when a bond layer is to be formed by a spraying step will be described in the following. The following three actions (1) to (3) are attained by preheating the surface of the parent aluminum alloy at such a temperature as high as 260° to 500° C., which is not suggested in the prior art, and by spraying the preheated parent surface with a spray material to form the bond layer:

(1) The parent material surface (i.e., the interface face between a diffusion layer and the parent material and the interface between the bond layer and the parent material) is finely roughened to have a height of several microns (or an average roughened of about Rz=3 to 15 microns on the center line;

(2) The diffusion layer is formed in the interface between the parent material and the bond layer to occupy 20 to 50% of the whole interface; and (3) The wettability of the spray material for the bond layer on the parent surface is improved.

By these concurrent three actions, the adherency of the bond layer to the parent surface is remarkably enhanced. These actions will be described in detail in the following.

In the Ni-based alloy used usually to make the bond layer, the spray particles have a temperature as high as about 1,400° to 1,500° C. If the surface of the parent aluminum alloy having already been preheated to a high temperature of 260° to 500° C. is bombarded with those hot spray particles, these particles will not be cooled to solidify at the portion of bombardment at the instant when they impinge upon the parent surface but raise the local temperature of the surface layer of the parent material to a level exceeding the melting point of the parent aluminum alloy to melt the local surface layer as deep as 5 to 30 microns. Moreover, the spray particles will penetrate into the molten parent surface layer by their bombardment so that the parent surface layer is finely roughened to have a height of several microns. This fine roughness in the parent surface means that not only the bond layer but also the continuous diffusion layer finely penetrate into the parent surface so that the mechanical anchoring effect is established to give a high adherency to the bond layer. If the preheating temperature of the parent material is lower than 260° C., the spray particles will be cooled to solidify at the instant they impinge upon the parent surface layer so that the parent surface layer is neither melted not finely roughened unlike the above discussion. As a result, it is impossible to improve the adherency of the bond layer by the mechanical anchoring effect.

As has been described above, the parent surface is locally melted by the bombardment of the bond layer spray particles, and turbulent flows are instantly generated in the contact interface between the molten layer of the parent surface and the spray particles by that bombardment. As a result, the alloy of the spray particles and the aluminum alloy of the parent surface will mix and diffuse in the liquid phases so that a diffusion layer due to their mutual diffusions is formed in the interface between the bond layer and the parent material. The diffusion layer thus formed is metallurgically united (or metallically bonded) at the atomic level to both the parent material and the bond layer so that it effectively functions to retain the adherency of the bond layer to the parent material. If the preheating temperature of the parent material is below 260° C., the portion of the diffusion layer occupies less than 20% the interface between the parent material and the bond layer in the area percentage. Then, the diffusion layer at this low ratio cannot have the adherency improved sufficiently. Incidentally, the diffusion layer itself is a mixture composed mainly of an intermetallic compound and of a nonmetallic inclusion such as oxides or silicides and is frequently fragile. As a result, if the occupation of the interface by the diffusion layer were excessive, the adherency improving effect might be saturated or lessened. Our experiments have revealed that the adherency improving effect due to the existence of the diffusion layer is attained for the occupation percentage of the interface by the diffusion layer up to 50%. It can therefore be concluded that the suitable percentage of the diffusion layer is 20 to 50%. Moreover, the percentage of the diffusion layer will exceed 50% if the preheating temperature of the parent material is over 500° C. It can also be concluded that the suitable preheating temperature is 500° C. or lower.

Still moreover, the wettability of the surface of the parent material by the spray particles is improved by the higher temperature of the surface of the parent aluminum alloy during the spraying step of the bond layer. A variety of causes can be thought including a first one, for which the surface of the parent aluminum alloy is preheated to a high temperature so that the silicon contained in an aluminum alloy or especially a casting aluminum alloy is oxidized on the parent surface to make its oxide, which has a better wettability than that of the metal to improve the wettability of the parent surface by the spray particles when in the spraying operation. If, moreover, the parent surface is preheated to the high temperature, the increases in the viscosity and surface tension of the spray particles due to the temperature drop when the spray particles come into contact with the parent surface are reduced to contribute to the improvements in the wettability. For either causes, it has been confirmed by our experiments that the wettability when the bond layer spray particles of the Ni-based alloy or the like impinge upon the surface of the parent aluminum alloy is improved by the higher preheating temperature of the parent material. If the wettability by the spray particles is thus excellent, the bond layer spray particles come into close contact with the parent surface to contribute to the improvements in the adherency of the bond layer.

As has been described above, the parent material of an aluminum alloy, which is preheated to a temperature as high as 260° to 500° C., is sprayed with a bond layer to form a diffusion layer in the interface between the parent material and the bond layer. The metallic binding action is established by that diffusion layer; the mechanical anchoring action is established by the fine roughness having a height of several microns on the surface of the parent material (i.e., in the interface between the diffusion layer and the parent material and the interface between the parent material and the bond layer); and the wettability improving action is established by the spray particles. These three actions synthetically function to remarkably enhance the adherency of the bond layer to the parent material thereby to effectively prevent the interface between the parent material and the bond layer from cracking from either the thermal stress due to the difference between the coefficients of thermal expansion between the parent material and the bond layer under the repeated heating-cooling conditions or the mechanical shearing stress as the sliding face.

Of the above-specified three actions, the formation of the diffusion layer is thought to contribute most to the improvement in the adherency.

If the preheating temperature of the parent aluminum alloy is lower than 260° C., those three actions cannot be sufficiently attained. Since the occupation percentage of the interface between the bond layer and the parent material by the diffusion layer is below 20%, it is difficult to retain sufficient adherency. If that preheating temperature exceeds 500° C., on the other hand, the area percentage of the diffusion layer occupying the interface exceeds 50%, as has been described above. Then, there is exhibited a tendency that the adherency improving effect is saturated or lessened by the fragility of the diffusion layer itself. The abrupt and excessive melting establishes porosity in the interface, and the adherency may possibly be inversely lessened. If the preheating temperature exceeds 500° C., moreover, the parent aluminum alloy may possibly be softened to deform the aluminum alloy member. For this reasoning, the preheating temperature of the parent material is limited to fall within the range of 260° to 500° C. A more preferable range is 350° to 450° C.

The bond layer is sprayed with a ceramic layer to provide a ceramic-sprayed member as a final product. The adherency of the interface between the bond layer and the ceramic-sprayed layer can be sufficiently retained by selecting as the bond layer a known Ni-based alloy having excellent adherence to a ceramic material. As a result, by preheating the parent material to 250° to 500° C. before the spraying of the bond layer to enhance the adherency of the interface between the parent material and the bond layer, according to the present invention, sufficient adherence can be attained over the entire sprayed layer to prevent occurrence of cracks due to the thermal stress and so on thereby to effectively prevent the sprayed layer from peeling.

In the sprayed member thus made according to the present invention, the diffusion layer in the interface between the bond layer and the parent material occupies 20 to 50% of the whole interface in area percentages, and the interface between the diffusion layer and the parent material and the interface between the bond layer and the parent material are finely roughened.

Here, if the percentage of the area occupied by the diffusion layer over the entire interface is less than 20%, it is impossible to attain the aforementioned adherency improving effect of the bond layer due to the existence of the diffusion layer. If the area percentage exceeds 50%, on the other hand, the fragility of the diffusion layer itself raises a tendency to saturate or lessen the adherency improving effect of the bond layer. Moreover, the formation of the diffusion layer in excess of 50% needs a temperature as high as 500° C. as the preheating temperature of the parent material to invite softening of the parent material. It follows that the area percentage of the diffusion layer in the interface between the bond layer and the parent material should be within a range of 20 to 50%. This range can afford the outstanding adherency improving effect of the bond layer.

On the other hand, the fine roughness of the interfaces between diffusion layer and the parent material and between the bond layer and the parent material can be established by melting the parent surface locally and finely during the bond layer spraying operation, as has been described above. Here, the fine roughness means a height of several microns or, more specifically, a height of 1 to 10 microns (or Rz=3 to 15 microns in a ten-point average roughness) but should exclude the coexistence of a coarser roughness. The coarse roughness (usually of Rz=30 to 40 microns) having a height of several tens microns is usually formed by shot-blasting the parent surface before the spraying of the bond layer. If the parent material is preheated to 260° to 500° C. to spray the bond layer after the formation of the coarse roughness by the shot-blasting, the coarse roughness having a height of several tens microns (Rz=30 to 40 microns) by the shot-blasting is superposed by the fine roughness having a height of several microns (Rz=3 to 15 microns) prepared by finely melting the parent surface. This superposition can naturally be allowed.

As described above, the existence of the fine roughness of a height of several microns in both the interface between the diffusion layer and the parent material and the interface between the bond layer and the parent material establishes the mechanical anchoring action, which is multiplied by the adherency improving effect due to the metallic binding of the diffusion layer to retain the strong adherency of the bond layer to the parent material.

The aluminum alloy to be used as the parent material in the present invention can be arbitrarily selected in accordance with the applications and required characteristics of the member and may be molded, diecast, forged or extruded. Especially in case where the piston of an automotive engine is to be produced, the parent material is usually a molding based on an Al—Si group or Al—Si—Ni group and is represented by an alloy of JIS AC8A or JIS AC8B (belonging to an Al—Si—Cu—Ni—Mg group) or an alloy of JIS AC8C (belonging to an Al—Si—Cu—Mg group). Incidentally, in the case where the wettability of the spray particles when in the bond layer spraying operation is increased to improve the bond layer adherency, it is preferable to use an aluminum alloy containing Si as the parent material.

In short, it is sufficient to use as the metal for the bond layer to be sprayed over the parent surface a metal which has a coefficient of thermal expansion intermediate between those of the ceramic-sprayed layer and the parent aluminum alloy and an excellent adherency to the ceramic. The optimum metal is represented by a Ni-based alloy such as a Ni—Cr, Ni—Al, Ni—Cr—Al, Ni—Cr—Al—Y or Ni—Co—Cr—Al—Y alloy but should not be limited thereto. Here: the representative Ni—Al alloy contains 5 to 10 wt% of Al, the remainder consisting substantially of Ni; the representative Ni—Cr alloy contains 15 to 20 wt% of Cr, the remainder consisting substantially of Ni; the representative Ni—Cr—Al alloy contains 16 to 20 wt% of Cr and 4 to 6 wt% of Al, the remainder consisting essentially of Ni; and the representative Ni—Cr—Al—Y alloy contains 16 to 20 wt%, 4 to 6 wt% of Al, 0.8 to 1.0 wt% of Y, the remainder consisting substantially of Ni.

The ceramic to be sprayed over the bond layer may be selected from ceramics of oxide groups such as $ZrO_2$ (including those stabilized with $Y_2O_3$, CaO or MgO), $Al_2O_3$, $TiO_2$, $Cr_2O_3$ or MgO, or their mixtures in accordance with the applications, heat resisting temperatures and so on.

The thickness of the bond layer should not be limited to specific values but may be usually set at 30 to 250 microns. On the other hand, the thickness of the ceramic-sprayed layer should not be limited to specific values but may be usually set at 0.3 to 1.0 mm from the standpoint that the present invention is effective in case a relatively thick ceramic-sprayed layer is formed with a view to heat insulation or shielding.

When the method of the present invention is to be practised, the surface layer of the parent aluminum alloy is preheated to a temperature within a range of 260° to 500° C., and the bond layer is sprayed in the preheated state. Here, the preheating of the parent surface layer may be accomplished by heating the parent material as a whole in a furnace. Then, this heating will take a long time and a high energy cost and may possibly drop the mechanical characteristics of the parent material in its entirety. It is therefore desirable to heat only the surface layer of the portion to be formed with the sprayed layer, locally with a burner or plasma flame.

It is sufficient to use the plasma-spraying method or the like as means for spraying the metal of the bond layer. Thus, by spraying the metal of the bond layer over the surface of the parent material which has been preheated to 260° to 500° C., as has been described hereinbefore, the parent surface is melted locally and finely as a result of the bombardment of the spray particles to establish the fine roughness of several microns and the mutual diffusion between the metal and the parent aluminum alloy thereby to form the diffusion layer. This diffusion layer is composed of, if the main component of the bond layer is M, mainly an intermetallic compound of M—Al and a mixture of an oxide (M—O) product and a silicide (M—Si) product. In case the Al—Si alloy or Al—Si—Ni alloy is used as the parent material and the Ni-based alloy is used as the bond layer, the diffusion layer is composed of mainly the intermetallic compound of $NiAl_x$ (x=1 to 4) and a mixture of the Ni—Si product and the Ni—O product.

After the spraying of the bond layer, it is sufficient to spray the ceramic by the plasma spraying method according to the prior art thereby to form the ceramic-sprayed layer.

Incidentally, it is desirable to roughen, prior to the preheating of the parent material, the surface of the portion to be formed with the sprayed layer by the shot-blasting method. It should be noted that the roughness achieved by the shot-blasting treatment is far coarser than the fine roughness of several microns established when in the bond layer spraying treatment, as has been described hereinbefore.

EXAMPLE 1

The ceramic-sprayed member was manufactured in the following manner by using a test piece of 100×20×5 mm cut from a molding of the JIS AC8A alloy as the parent material; an N—Cr—Al alloy (composed of 18.8 wt% of Cr, 6 wt% of Al, the remainder being Ni) as the bond layer spraying material; and $ZrO_2.8Y_2O_3$ as the ceramic spraying material.

First of all, the surface of the parent material was rinsed for 30 seconds with trichlene and shot-blasted to have a roughness of Rz of 30 microns. Then, the parent surface layer was preheated to various temperatures ranging from 100° to 500° C. with a plasma spray gun and was plasma-sprayed with the Ni—Cr—Al alloy to have a thickness of 0.1 mm and with $ZrO_2.8Y_2O_3$ to have a thickness of 0.5 mm to make a ceramic-sprayed member.

As to the individual ceramic-sprayed members thus obtained at the various preheating temperatures, the shearing adherency tests of the interface between the parent material and the bond layer of Ni—Cr—Al alloy were conducted to examine the adherency between the bond layer and the parent material. The results are presented in FIG. 1 compared to the individual preheating temperatures.

As is apparent from FIG. 1, the adherency between the parent material and the bond layer is seen to abruptly rise from the vicinity of the preheating temperature of 260° C. with the rise of the preheating temperature and to exhibit the maximum adherency of 12 $Kgf/mm^2$ on the average in the vicinity of the preheating temperature of 400° C.

Figure 2A:
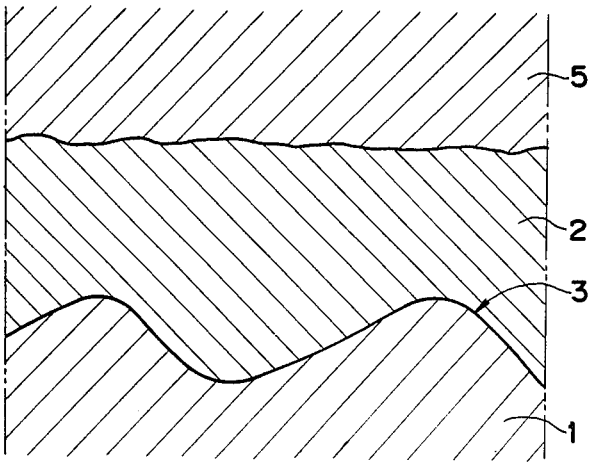
FIGS. 2A and 2B are schematic sections for illustrating the situations of the interface between the parent material and the bond layer at preheating temperatures of 100° C. and 400° C., respectively.

The situations of the interface between the parent material and the bond layer of the ceramic-sprayed member used_in those experiments were observed. These observations revealed that the ceramic-sprayed member made at the preheating temperature of 100° C. below the level 260° C. has only a roughness of Rz=30 microns due to the shot-blasting in the interface 3 between the parent material 1 and the bond layer 2, as shown in FIG. 2A. On the other hand, the ceramic-sprayed member made at the preheating temperature of 400° C. has a fine roughness 4 having a height of several microns and a roughness of Rz=10 microns in superposition upon the roughness of Rz=30 microns due to the shot-blasting.

Figure 2B:
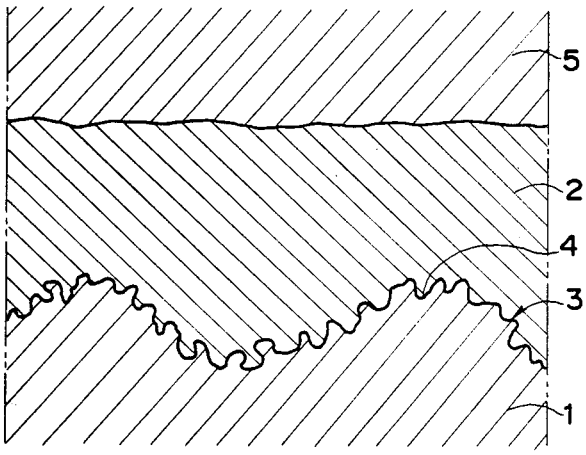

This fine roughness 4 was observed in all the members made at a preheating temperature equal to or higher than 260° C. Incidentally, reference numeral 5 appearing in FIGS. 2A and 2B designates a ceramic-sprayed layer.

Figure 3:
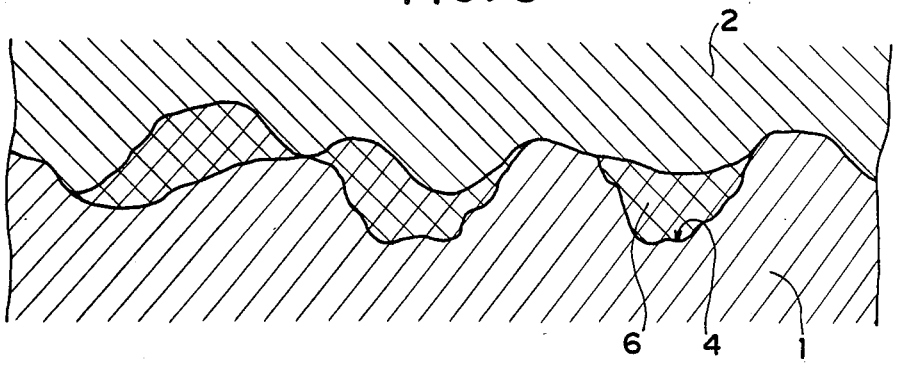
FIG. 3 is also a schematic section showing the situations of the interface between the parent material and the bond layer in an enlarged scale.

The situations of the metallic structure of the interface between the bond layer and the parent material of the ceramic-sprayed member made at a preheating temperature not lower than 260° C. were examined to confirm the formation of a diffusion layer 6 in which the components of the bond layer 2 and the parent material 1 diffuse into each other, as shown in FIG. 3. According to the analysis using an X-ray microanalyzer, it was revealed that the diffusion layer 6 is a complicated mixture which is composed of mainly an intermetallic compound of $NiAl_x$ (x=1 to 4), a product of the Ni—Si group of the Ni of the bond layer and the Si of the parent material, and a product of the Ni—O group.

Figure 4:
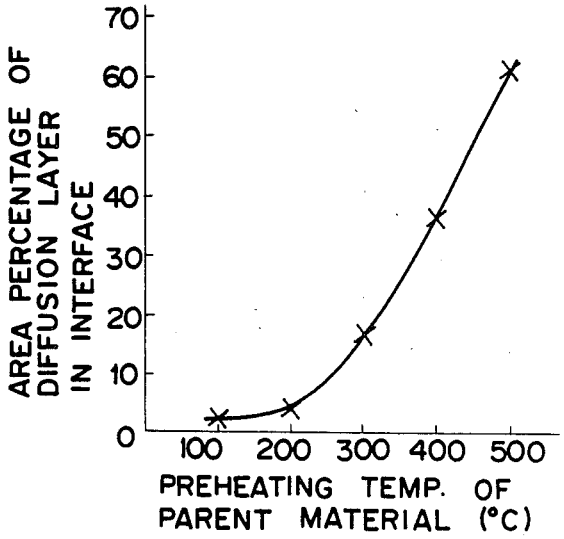
FIG. 4 is a graph presenting the relation between the preheating temperature of the parent material and the area percentage of a diffusion layer occupying the interface of the parent material and the bond layer.

The occupation percentage of the diffusion layer between the parent material and the bond layer in the intire interface was examined as to the ceramic-sprayed members made at the individual preheating temperatures, and the results of these examinations were presented in FIG. 4. It is found from FIG. 4 that the occupation percentage of the diffusion layer increases with the rise of the preheating temperature abruptly from the vicinity of the preheating temperature of 260° C.

From the relations (as shown in FIG. 4) between the occupation percentage of the diffusion layer and the parent preheating temperature and the relations (as shown in FIG. 1) between the parent preheating temperature and the bond layer adherency, it is apparent that the rise of the adherency with the rise in the parent preheating temperature or especially the abrupt rise of the adherency at a preheating temperature exceeding 260° C. is highly influenced not only by the mechanical anchoring effect due to the fine roughness of the interface between bond layer and the parent material but also by the metallic binding due to the formation of the diffusion layer.

As seen from FIG. 1, the adherency of the bond layer reaches 12$Kgf/mm^2$ at the preheating temperature of 400° C., and the adherency itself at a preheating temperature between 260° to 500° C. is 7 to 8 $Kgf/mm^2$ at the least. This value is so high as cannot be attained in the prior art. In other words, with only the shot-blasting treatment without any positive preheating treatment, the adherency is at 3 $Kgf/mm^2$ at the highest and has failed to reach 7 to 8 $Kgf/mm^2$ even when the parent material is preheated to 130° to 250° C.,

EXAMPLE 2

Figure 5:
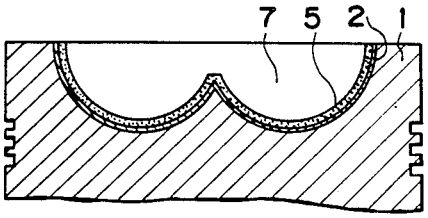
FIG. 5 is a longitudinal section showing a ceramic-sprayed member which is applied to a piston according to one embodiment of the present invention.

The present invention was applied to the combustion chamber of a Diesel engine piston, as shown in FIG. 5.

The piston parent material 1 of the JIS AC8A was rinsed for 30 seconds with trichlene, and then its combustion chamber 7 had its inner face shot-blasted. Then, the inner face of the combustion chamber 7 was heated to 400° C. with a propane gas burner and was plasma-sprayed to form the bond layer 2 and the ceramic-sprayed layer 5. The bond layer 2 was made of the Ni—Cr—Al alloy to have a thickness of 0.1 mm, and the ceramic-sprayed layer 5 was made of $ZrO_2.8Y_2O_3$ to have a thickness of 0.5 mm.

The ceramic-sprayed piston thus made was incorporated in a turbo-Diesel engine so that its running durability might be examined. The test conditions were: the number of revolutions of 4,000 r.p.m.; the supercharge pressure of 600 mmHg; and the test time of 300 hours.

For purpose of comparison, the running durability tests of the ceramic-sprayed piston, which had been likewise made except for the preheating temperature of the piston parent material at 120° C., were also conducted under the identical conditions.

The test results were: the sprayed layer of the ceramic-sprayed piston of the preheating temperature of 120° C. had its interface between the parent material and the bond layer peel within 0.5 hours after the test start. This is because the adherency of the bond layer to the parent material could not cope with the thermal stress due to the difference in thermal expansion. In the ceramic-sprayed piston of the preheating temperature of 400° C., on the other hand, there was found no trouble even after durability testing for 300 hours.

Moreover, those two kinds of ceramic-sprayed pistons were cut to examine the interfaces between their parent materials and bond layers. Like the Example 1, the ceramic-sprayed piston of the preheating temperature of 120° C. had neither any substantial diffusion layer nor the fine roughness of several microns. On the contrary, the ceramic-sprayed piston of the preheating temperature of 400° C. was confirmed to have its interface formed with a diffusion layer in an area percentage of about 40% to the entire interface and to be finely roughened to have a height of several microns and a roughness of Rz=10 microns.

In the Examples thus far described, the bond layer spraying material was the Ni—Cr—Al alloy. It was, however, confirmed that diffusion layers composed mainly of the intermetallic compound of the Ni—Al group and the products of the Ni—Si and Ni—O groups were formed even in case the Ni—Al alloy, the Ni—Cr alloy and the Ni—Cr—Al—Y alloy, respectively.

According to the present invention, the ceramic-sprayed member made by spraying the bond layer of the Ni-based alloy or the like over the surface of the parent material of an aluminum alloy and by forming the ceramic-sprayed layer over that bond layer can have a remarkably high adherency of the bond layer to the parent material. As a result, the durability of the ceramic-sprayed member can be improved far better than that of the prior art by effectively preventing the interface between the parent material and the bond layer from cracking to cause the sprayed layer to peel because of the thermal stress due to the difference in the thermal expansion or other mechanical shearing stresses. According to the present invention, moreover, a remarkably long heat treatment such as the diffusion-heat treatment after the bond layer spraying operation can be eliminated to provide the ceramic-sprayed member having the aforementioned excellent adherency at a low cost and with a high productivity.

We claim:

1. A ceramic-sprayed member having a ceramic-sprayed layer on the surface of a parent material of an aluminum alloy with an intermediate sprayed bond layer which is made of an alloy having a coefficient of thermal expansion intermediate between those of the aluminum alloy of the parent material and the ceramic of the ceramic-sprayed layer, to provide excellent adherency of the parent material surface to the ceramic;

the improvement comprising a diffusion layer in which the components of said bond layer and said parent material are diffused into each other, said diffusion layer being formed in an interface between said bond layer and said parent material and occupying 20 to 50% of said interface in an area percentage; and an interface between said diffusion layer and said parent material and the interface between said bond layer and said parent material being finely roughened substantially entirely over these interfaces.

2. A ceramic-sprayed member according to claim 1, wherein said fine roughness has a level ranging from Rz=3 to 15 microns.

3. A ceramic-sprayed member according to claim 1, wherein said bond layer is made of a nickel-based alloy.

4. A ceramic-sprayed member according to claim 1, wherein said diffusion layer is made mainly of an intermetallic compound containing aluminum and nickel.

* * * * *

UNITED STATES PATENT AND TRADEMARK OFFICE

CERTIFICATE OF CORRECTION

PATENT NO. : 4,885,213

DATED : December 5, 1989

INVENTOR(S) : Moritaka MIYAMOTO et al.

It is certified that error appears in the above-identified patent and that said Letters Patent is hereby corrected as shown below:

In the Cover Page, Section [75], line 3: change "Takashi Iomoda" to --Takashi Tomoda--.

Signed and Sealed this

Twentieth Day of August, 1991

*Attest:*

*Attesting Officer*

HARRY F. MANBECK, JR.

*Commissioner of Patents and Trademarks*